US007357620B2

(12) United States Patent
Russak et al.

(10) Patent No.: US 7,357,620 B2
(45) Date of Patent: Apr. 15, 2008

(54) DUAL USE COOLING FAN AND AIR CIRCULATOR

(75) Inventors: Stephen Russak, Demarest, NJ (US); Anthony DeMore, New York, NY (US); Alvaro Miguel Pinto de Araujo, Vila Nova de Gaia (PT); Anthony Lai, Burlington, MA (US); David Bossa, New York, NY (US); Lucki Wang, New York, NY (US); Sam Lin, New York, NY (US)

(73) Assignee: Kaz, Incorporated, New York, NY (US)

( * ) Notice: Subject to any disclaimer, the term of this patent is extended or adjusted under 35 U.S.C. 154(b) by 81 days.

(21) Appl. No.: 11/335,863

(22) Filed: Jan. 18, 2006

(65) Prior Publication Data

US 2007/0166155 A1 Jul. 19, 2007

(51) Int. Cl.
*F04D 25/16* (2006.01)

(52) U.S. Cl. ..... 415/213.1

(58) Field of Classification Search ..... 415/60, 415/101, 102, 213.1, 121, 148, 205, 244 R, 415/246, 247 R See application file for complete search history.

(56) References Cited

U.S. PATENT DOCUMENTS

| | | | | |
|---|---|---|---|---|
| 2,117,310 | A | 5/1938 | Garrott | |
| 2,123,448 | A | 7/1938 | Weber | |
| 2,667,301 | A | 1/1954 | Lautner | |
| 5,368,445 | A | 11/1994 | Litvin et al. | |
| 5,431,544 | A | 7/1995 | Hsu et al. | |
| 5,480,282 | A | 1/1996 | Matson | |
| 5,609,473 | A | 3/1997 | Litvin | |
| 6,321,034 | B2 * | 11/2001 | Jones-Lawlor et al. | 392/367 |
| 6,340,283 | B1 * | 1/2002 | Hedger et al. | 415/60 |
| 2005/0232753 | A1 | 10/2005 | Hopkins | |

* cited by examiner

*Primary Examiner*—Edward K. Look
*Assistant Examiner*—Dwayne J White
(74) *Attorney, Agent, or Firm*—Darby & Darby

(57) ABSTRACT

A fan assembly that can be used as a cooling fan or an air circulator. The fan assembly can provide the cooling and air circulation functions simultaneously or separately. The intensity of the cooling and/or air circulation can be individually controlled and directed. The fan assembly includes a base unit, a mounting frame rotatably coupled to the base unit, and a plurality of blower housings, each enclosing a fan and coupled to the mounting frame. The mounting frame is rotatable about an axis parallel to the support plane of the base. At least one of the blower housings is rotatably mounted to the mounting frame. The position of the blower housings can be adjusted through the manipulation of a positioning handle that is coupled to the rotatable blower housing.

13 Claims, 6 Drawing Sheets

DUAL USE COOLING FAN AND AIR CIRCULATOR

FIELD OF THE INVENTION

The present invention relates to portable fans and, more particularly, to a fan that can function as an air circulator and a cooling fan, independently or simultaneously.

BACKGROUND OF THE INVENTION

Portable fans are employed for a variety of purposes including air circulation and convective cooling. Portable fans are relatively small and light, and are intended to be placed on the floor or on a countertop. The most frequently used forms of portable fans are the box fan and the pedestal fan which have an axial flow fan contained within an enclosure which is placed on the floor or mounted atop a pedestal, respectively.

Many improvements have been included in the design of portable fans to optimize or enhance their performance as coolers and air circulators. Specifically, improvements have been made in controlling the volume and direction of airflow to suit the purpose for which the fan is employed.

To enhance the convective cooling ability of fans, different ways of directing the air-stream generated by a fan towards a particular target have been developed. For example, fan enclosures have been pivotally mounted atop a pedestal so that the fan can be angularly rotated about the vertical axis to adjust the direction of the airflow in the horizontal plane. To adjust the vertical elevation of the airflow, fans have been rotatably mounted to a U-shaped base forming a yoke-like structure, thereby allowing the fan to be adjusted so that the airflow is directed at a specific target in the vertical plane. These two adjustment configurations, in combination, allow the air-stream generated by a fan to be directed toward any target within a room regardless of where the base of the fan is located.

Another use of portable fans is general air circulation. Directed airflow may cool one target, but may not generally reduce or equilibrate the temperature of a room. This latter problem further persists in part due to the stratification of the air temperature in a room. To break up the stratification of the air in a room, a floor circulator can be employed to vertically direct the air flow from the fan to create turbulence within a room and break down the stratification.

U.S. Pat. No. 2,667,301 demonstrates the complementary nature of air circulation and convective cooling. This patent discloses a fan mounted to a base unit which allows the vertical direction of the generated airflow to be altered by rotating the fan about a horizontal mounting axis. The fan further includes legs on the front face of the fan that allow the fan to be placed flat against the floor to circulate room air by creating turbulent vertical flow.

SUMMARY OF THE INVENTION

The present invention is directed to a fan assembly that can be used as a cooling fan or an air circulator. The fan assembly can provide the cooling and air circulation functions simultaneously or separately. The intensity of each provided function can be individually controlled and directed.

The fan assembly includes a base unit forming a yoke-like structure, a mounting frame rotatably coupled to the base unit, and a plurality of blower housings, each enclosing a fan, coupled to the mounting frame. The mounting frame is rotatable about an axis, preferably parallel to the support plane of the base. At least one of the blower housings is rotatably mounted to the mounting frame.

The fan assembly can be positioned so that all fans are directed at a specific object, thereby cooling the object. Alternatively, the fan assembly can be positioned so that all fans are directed upward or downward, either slightly or completely, thereby maximizing the air circulation within a room. The mounting frame may be rotated so that at least one fan blower provides air circulation, and at least one fan blower directs its air flow at a specific object. Thus, the fan simultaneously provides both air circulation and air cooling.

In a preferred embodiment, the blower housing that is rotatably mounted to the mounting frame is rotatable about an axis parallel to the axis of rotation of the mounting frame. However, it is contemplated that any rotatably mounted blower housings can be rotatable along any axis. It is further contemplated that one or more of the blower housings are rotatably mounted to the mounting frame. Preferably, the fan assembly is portable and includes a carrying handle for easily carrying the assembly.

In a preferred embodiment of this invention, the fan assembly includes two blower housings. A first blower housing rotatably mounted to the mounting frame so that it is rotatable about an axis parallel to the axis of rotation of the mounting frame. The second blower housing is fixed within the mounting frame. In this embodiment, if the fan assembly is placed on the floor such that the axis of rotation of the mounting frame and the rotatable blower housing are within the same vertical plane, both fan blowers direct air within the same vertical plane. Thus, the direction of the air flow in the vertical plane of the fixed blower housing is controlled by the rotation of the mounting frame, and the direction of the air flow of the rotatable blower housing is controlled by the rotatable mounting of the blower housing to the mounting frame. Additionally, it is preferred that the rotatable blower housing includes a positioning handle that allows the airflow from both fans to be adjusted by manipulating the rotation and position of the positioning handle.

The fan assembly may provide multiple speeds of rotation for each fan. The fan speed may be controlled by a single controller, or preferably the fan assembly provides individual control of the speed of rotation of each blower. Individual fan control provides for individual control over the degree of cooling and the degree of air circulation.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
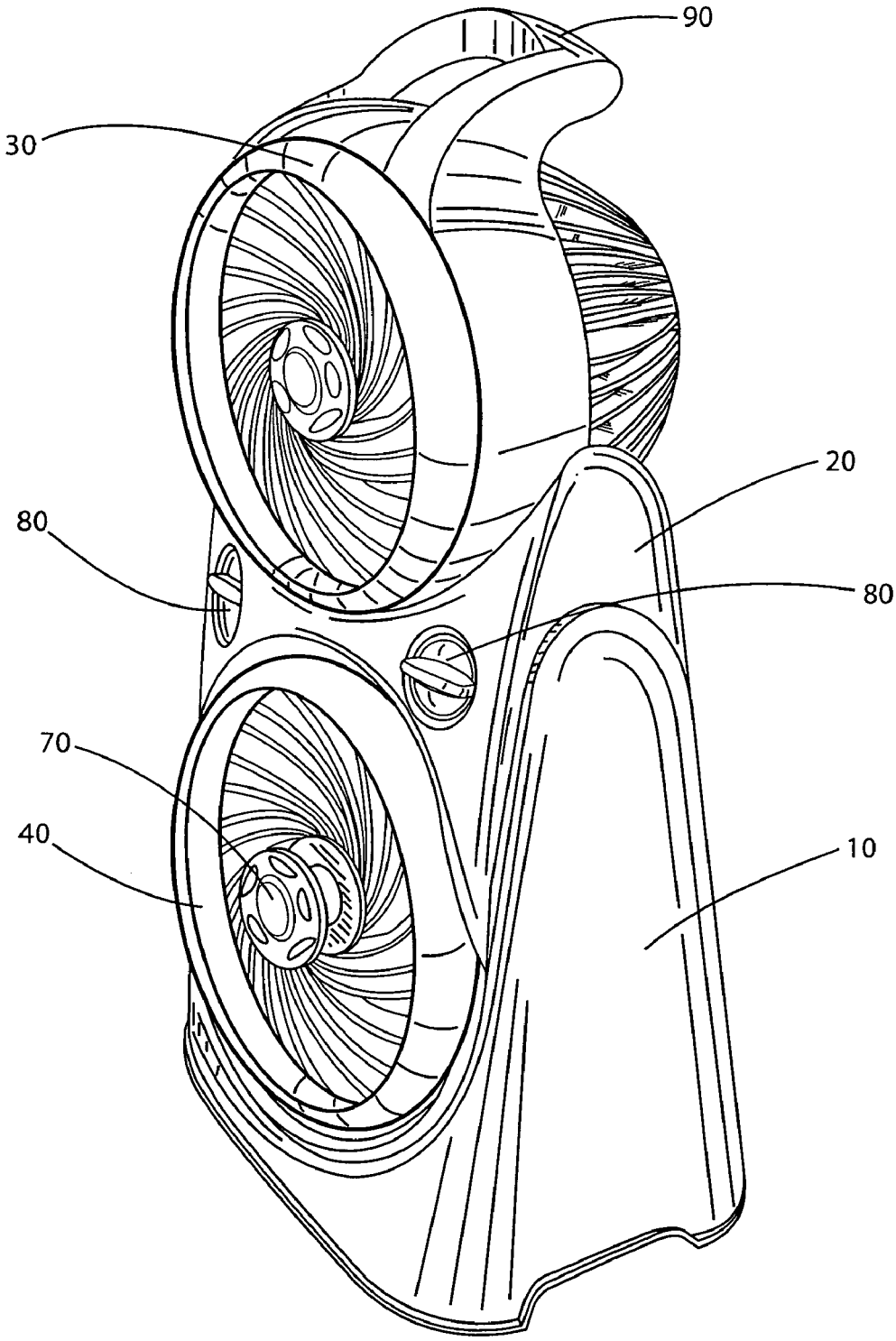
FIG. 1 is a top front perspective view of a first embodiment of the invention.
Figure 2:
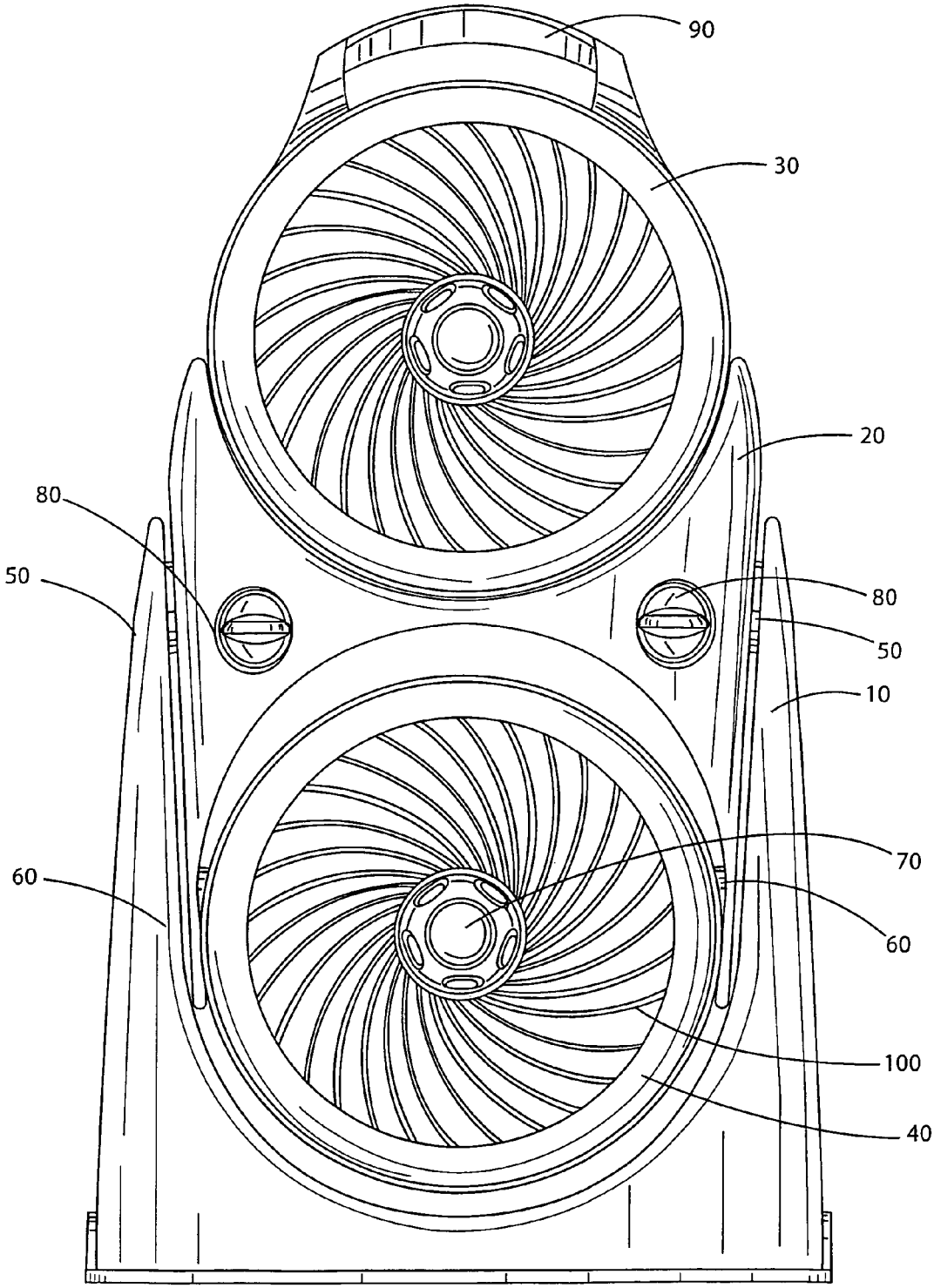
FIG. 2 is a front elevation view of a first embodiment of the invention.

Referring now to the drawings, the present invention is directed to a fan assembly that can be used as a cooling fan or an air circulator. The fan assembly can provide the cooling and air circulation simultaneously or independently. The intensity of each provided function can be individually controlled and directed.

Referring to FIGS. 1-7, the fan assembly includes a base unit 10 forming a yoke-like structure, a mounting frame 20 rotatably coupled at pivot mounts 50 to the base unit 10, and first and second blower housings 30 and 40, each enclosing a fan, coupled to the mounting frame 20. The mounting frame 20 is rotatable about an axis, for example an axis formed by a line going through pivot mounts 50, preferably parallel to the support plane of the base 10. Blower housing 30 is fixedly mounted to the mounting frame 20. Blower housing 40 is rotatably mounted to the mounting frame 20 and is rotatable about an axis, for example an axis formed by a line going through pivot mounts 60. Blower housing 40 may be rotatable about any axis. Preferably, however, the axis of rotation of blower housing 40 is parallel to the axis of rotation of the mounting frame 20. The position of the fan assembly relates to the degree of rotation of the mounting frame 20 and the degree of rotation of the rotatably mounted blower housing 40. Alternatively, blower housings 30 and 40 can be rotatably mounted to the mounting frame 20, or blower housing 30 can be rotatably mounted, and blower housing 40 can be fixedly mounted. It is further contemplated that more than two blower housings can be mounted to the mounting frame 20, with at least one blower housing rotatably mounted. Additional blower housings may be rotatably mounted or fixed within the frame. It is further contemplated that each blower housing may include multiple fan blowers.

The fan assembly can be positioned such that all fans are directed at a specific object, thereby cooling the object. Alternatively, the fan assembly can be positioned so that blower housings 30 and 40 are directed upward or downward, either slightly or completely, thereby maximizing the air circulation within a room. The mounting frame 20 may be rotated so that blower housing 30 provides air circulation, and rotatably mounted blower housing 40 may be positioned so that its air flow is directed at a specific object. The fan, thus, simultaneously provides both air circulation and air cooling.

Figure 3:
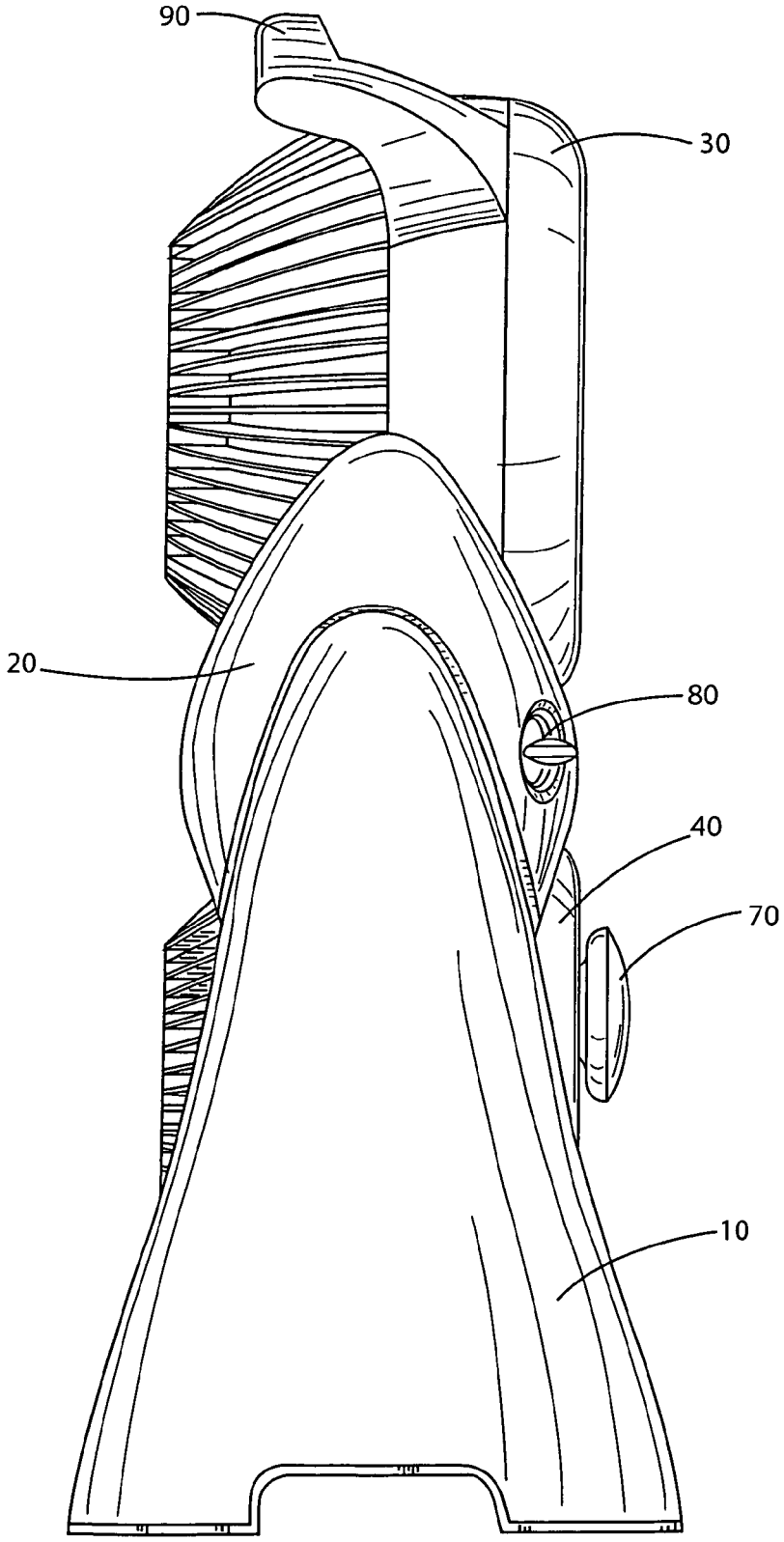
FIG. 3 is a left side elevation view of the first embodiment of the invention.
Figure 4:
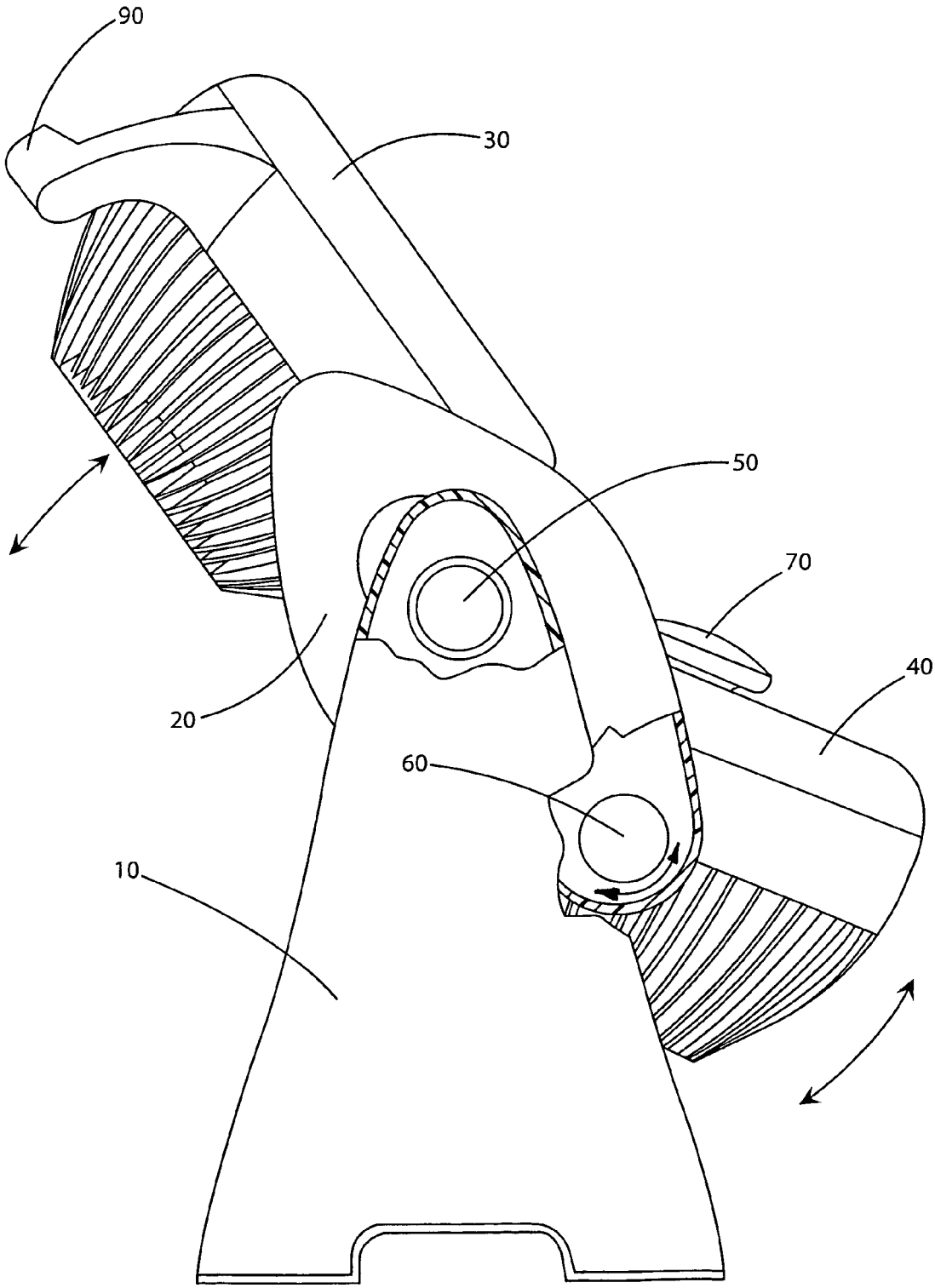
FIG. 4 is a left side elevation view with parts broken away of the first embodiment of the invention in an alternate position.
Figure 5:
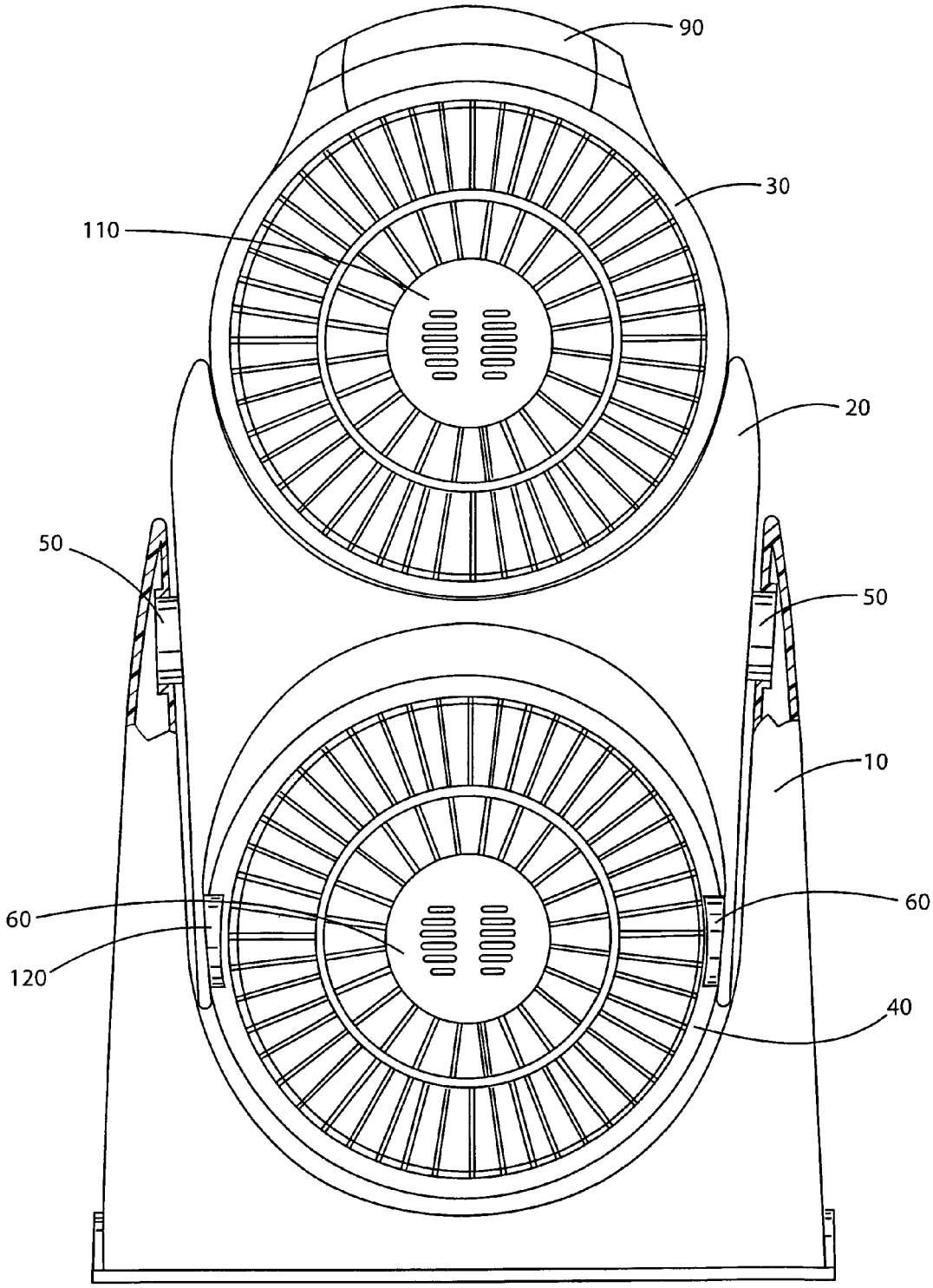
FIG. 5 is a rear elevation view with parts broken away of the first embodiment of the invention.
Figure 6:
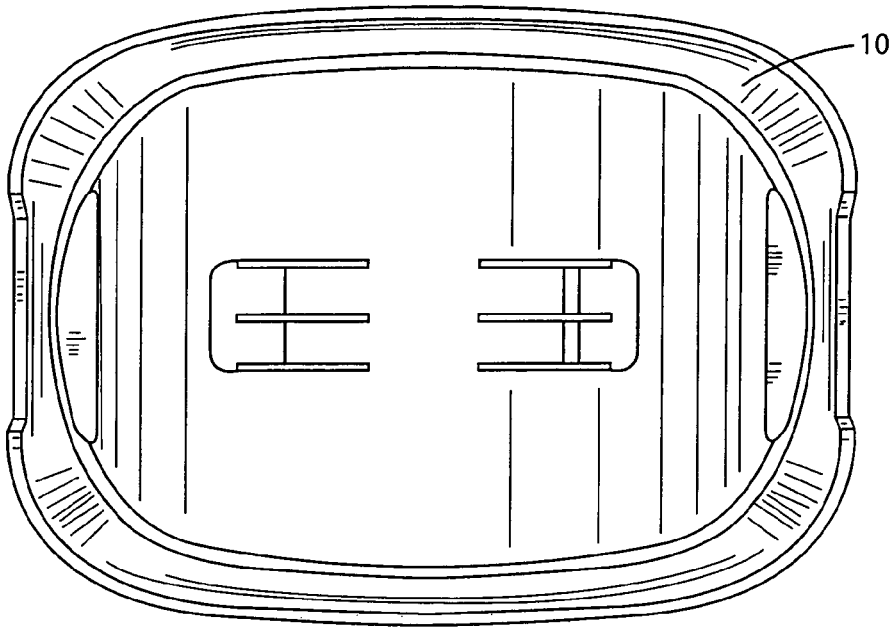
FIG. 6 is a bottom plan view of the first embodiment of the invention.
Figure 7:
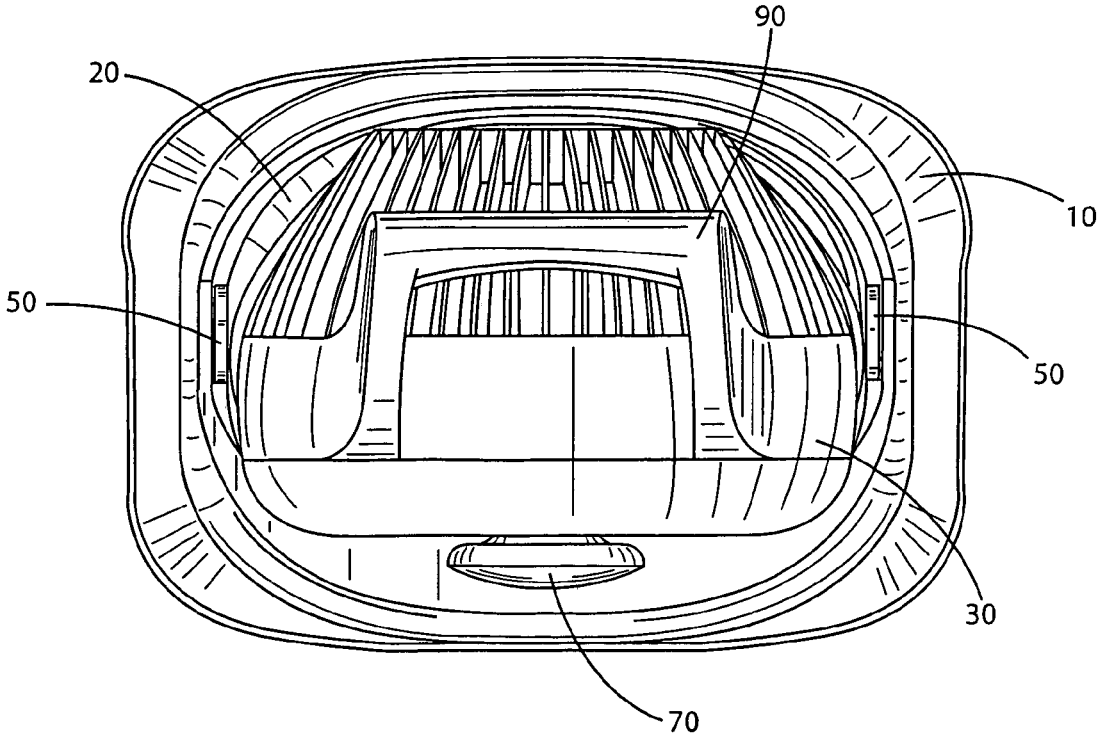
FIG. 7 is a top plan view of the first embodiment of the invention.

In one embodiment, shown in FIGS. 1-7, the fan assembly includes two blower housings 30 and 40. The mounting frame 20 includes a fixed mounting end and a rotatable mounting end. Blower housing 30 is mounted to the fixed mounting end of the mounting frame 20, and blower housing 40 is rotatably mounted to the rotatable mounting end at pivot mount 60. Thus, blower housings 30 and 40 are on opposite sides of the axis of rotation of the mounting frame 20. Blower housing 30 is fixed to the mounting frame 20 so that the direction of its airflow is determined by the rotation of the mounting frame 20. Blower housing 40 is rotatably mounted to the mounting frame 20 so that it is rotatable about an axis parallel to the axis of rotation of the mounting frame 20. FIGS. 3 and 4 illustrate the fan assembly in varying positions, and illustrate that the rotation of mounting frame 20 about pivot mounts 50 determines the direction of the airflow of blower housing 30 and that the rotation of blower housing 40 about pivot mounts 60, in conjunction with the rotation of mounting frame 20, directs the air flow of blower housing 40.

The base unit 10 provides support for the fan when it is placed on the ground or other flat surface. The area of support of the base unit 10 is preferably sufficiently sized to maintain the fan's upright position by ensuring the center of gravity of the fan assembly is located within the area of support for all possible fan positions. Alternatively, the base unit 10 may be mounted to the wall or another surface, in which case the base unit 10 would not be required to support the fan's upright position.

In one embodiment, shown in FIGS. 1-7, the blower housing 40 includes a positioning handle 70 located in the center of the grill 100. While the positioning handle 70 may be located anywhere on the blower housing 40, a substantially central location allows the air flow of both blowers 30 and 40 to be adjusted through a single adjustment motion. Because the positioning handle 70 is offset from the axis of rotation of the mounting frame 20, it provides leverage for rotating the mounting frame 20. Also, because the positioning handle 70 projects away from the axis of rotation of the blower housing 40, it acts as a lever when positioning the blower housing 40. Thus, by manipulating only the positioning handle 70 on the blower housing 40, the position of the fan assembly may be controlled.

The fan assembly may include a carrying handle 90 to assist in the transportation of the assembly. The handle may be located anywhere on the fan assembly. In one preferred embodiment, the carrying handle 90 is located on the top of the blower housing 30 on top of the fan assembly. This location provides the greatest stability since, when the fan assembly is lifted by the carrying handle 90 from an upright position, the center of gravity of the fan assembly will be generally below the carrying handle 90. Alternatively, the carrying handle 90 could be located on the mounting frame 20 or on the base unit 10 to provide stability while being transported.

The fan assembly may provide multiple speeds of rotation for each fan. The fan speed may be controlled by a single controller, or preferably the fan assembly includes individual controllers 80 that adjust the speed of rotation of each individual blower. Individual fan controllers 80 provide for individual control over the degree of cooling and the degree of air circulation. The embodiment shown in FIGS. 1-7 includes two fan controllers 80, each controlling one of the fan blowers in blower housings 30 and 40.

The fan assembly further includes electrical wiring to provide power to the fans. The wiring may be provided directly to each fan motor 110 and 120. Preferably, the wiring is placed inside the fan assembly, thereby minimizing the exposed and visible wiring. Internal wiring increases the safety of the device by minimizing exposed wiring, and enhances the esthetic of the fan assembly. Specifically, in reference to the embodiment shown in FIGS. 1-7, the wiring may enter the base unit 10 and run into the mounting frame 20 through the rotatable mounting pivot 50. The wiring is then run through the fan blower housings 30 and 40 to the fan motors 110 and 120. The wiring to the rotatably mounted blower housing 40 may run through the rotatable mounting pivot 60 into the fan blower housing 40 and then connect to the fan motor 120.

While the invention has been shown by way of reference to a dual use air circulator and a cooling fan and particularly shown and described with reference to preferred embodiments thereof, it will be understood by those skilled in the art that the present invention may be utilized in any air circulator and a cooling fan and that various changes in form and details may be made therein without departing from the spirit and scope of the invention.

We claim:

1. A fan assembly comprising:

a base support forming a yoke;

a mounting frame rotatably mounted to the base support about a first axis; and first and second blower housings, each housing enclosing a fan blower and mounted to the mounting frame;

wherein at least one of the first and second fan blowers is rotatably mounted to the mounting frame.

2. The fan assembly of claim 1, wherein at least one of the first and second fan blowers is rotatable about a second axis parallel to the first axis.

3. The fan assembly of claim 1, wherein the base support is sufficiently sized to maintain the upright position of the assembly for all possible positions of the fan assembly.

4. The fan assembly of claim 1, wherein the mounting frame includes a fixed mounting end and a rotatable mounting end, and one of the first and second blower housings is rotatably mounted to the rotatable mounting end, and the other blower housing is fixedly mounted to the fixed mounting end.

5. The fan assembly of claim 4, wherein the fixed mounting end of the mounting frame and the rotatable mounting end of the mounting frame are on opposite sides of the first axis.

6. The fan assembly of claim 2, further comprising a positioning handle mounted to the rotatably mounted blower housing.

7. The fan assembly of claim 6, wherein the positioning handle is mounted to the center of the rotatably mounted blower housing.

8. The fan assembly of claim 1, wherein the rotation of the mounting frame is limited to a specified range of rotation.

9. The fan assembly of claim 1, wherein the rotation of the at least one rotatably mounted blower housings is limited to a specified range of rotation.

10. The fan assembly of claim 1, further comprising a carrying handle coupled to the mounting frame.

11. The fan assembly of claim 1, further comprising a power control unit configured to independently operate the first fan blower at a first speed and to independently operate the second fan blower at a second speed.

12. The fan assembly of claim 1, further comprising wiring for providing electrical power to each of the at least first and second fan blowers, the wires being contained within at least one of the base support, the mounting frame, and the blower housing.

13. A fan assembly comprising:

a base support forming a yoke;

a mounting frame rotatably mounted to the base support, and rotatable about a first horizontal axis, having a rotatable mounting end and a fixed mounting end, the rotatable mounting end and the fixed mounting end on opposite sides of the first horizontal axis;

a first blower housing enclosing a first blower fan, and having a grill, and being mounted to the fixed mounting end of the mounting frame;

a second blower housing enclosing a second blower fan, and having a grill rotatably mounted to the rotatable mounting end of the mounting frame, and rotatable about a second horizontal axis parallel to the first horizontal axis; and a positioning handle coupled to the grill of the second blower housing.

* * * * *